US007153248B2

(12) United States Patent
Chen

(10) Patent No.: US 7,153,248 B2
(45) Date of Patent: Dec. 26, 2006

(54) ADJUSTMENT ASSEMBLY FOR A UNIVERSAL EXERCISING MACHINE

(76) Inventor: Chih-Liang Chen, No. 66, Alley 71, Lane 252, Sec. 2, Jieshou Rd., Pateh City, Taoyuan Hsien (TW)

( * ) Notice: Subject to any disclaimer, the term of this patent is extended or adjusted under 35 U.S.C. 154(b) by 2 days.

(21) Appl. No.: 11/098,460

(22) Filed: Apr. 5, 2005

(65) Prior Publication Data

US 2006/0223685 A1 Oct. 5, 2006

(51) Int. Cl.
*A63B 21/02* (2006.01)
*A63B 21/04* (2006.01)

(52) U.S. Cl. ..... 482/121; 482/122; 482/129; 482/908

(58) Field of Classification Search ..... 482/121, 482/908, 135–137, 17, 142, 127
See application file for complete search history.

(56) References Cited

U.S. PATENT DOCUMENTS 4,725,057 A * 2/1988 Shifferaw ..... 482/130
5,688,216 A * 11/1997 Mauriello ..... 482/135
6,238,323 B1 * 5/2001 Simonson ..... 482/103
6,387,024 B1 * 5/2002 Monti et al. ..... 482/142
6,422,980 B1 * 7/2002 Simonson ..... 482/99
6,488,612 B1 * 12/2002 Sechrest et al. ..... 482/103
2002/0151419 A1 * 10/2002 Barnes et al. ..... 482/142

* cited by examiner

*Primary Examiner*—Stephen R. Crow
*Assistant Examiner*—Arun S. Chhabra
(74) *Attorney, Agent, or Firm*—Bacon & Thomas, PLLC

(57) ABSTRACT

An adjustment assembly for a universal exercising machine includes two blocks respectively adapted to have resilient rods to be mounted thereon and being movable relative to the frame and each block having a first pathway and a second pathway to respectively allow extension of an adjustment device and a securing bolt and nut combination and two adjustment disks to sandwich therebetween the two blocks. Each adjustment disk has two sets of openings respectively defined in two opposed sides of the adjustment disk and two passages respectively provided to communicate with one set of openings. Each opening has a dimension larger than that of the passage so that when the adjustment device is selectively received in the passage, the blocks are able to be moved relative to the frame.

2 Claims, 7 Drawing Sheets

ADJUSTMENT ASSEMBLY FOR A UNIVERSAL EXERCISING MACHINE

BACKGROUND OF THE INVENTION

1. Field of the Invention

The present invention relates to an adjustment assembly for a universal exercising machine, and more particularly to an adjustment assembly to allow the resilient rods of the universal exercising machine to adjust their relative angles so as to adapt to different requirements.

2. Description of Related Art

Nowadays various types of exercising machines and devices are available on the market. One conventional exercising device in U.S. Pat. No. 4,620,704 and in FIG. 6 has a base (5), a frame (6) formed on an end of the base (5), multiple resilient rods (7) securely mounted on the frame (6) and two handle cables (8) respectively attached to two corresponding resilient rods (7). At each free end of the two handle cables (8), a handle (81) is securely provided. A user of this universal exercising machine is able to stand, sit or lie on the base (5) and pull the two handles (81). Due to different inclination angles of the resilient rods (7), when the handle cables (8) are connected to different resilient rods (7), the user has to develop different strengths to overcome different resistances from the resilient rods (7) and thus different areas of muscles are worked. It is noted that the handle cables (8) are changeable among the resilient rods (7) though, the user's posture is limited in that the two handles (81) are generally fixed to opposed sides of the frame (6). Furthermore, the resilient rods (7) are firmly fixed to the frame (6) so that it is impossible to adjust the inclination of each of the resilient rods (7). As a result, when the user is standing on the base (5) and trying to work on arm muscles, the user has to first overcome the resistance from the two resilient rods (7) so as to properly stand on the base (5) with the two handles (81) being hand held. That is, even before the start of workout, the user is frustrated trying to overcome the resilient rod resistance everytime the user changes position or posture, and inappropriate development of muscles may occur. That is, body builders have precise goals in the development of specific muscles and wasted effort may defeat the exerciser's goals, as well as resulting in lopsided physique.

To overcome the shortcomings, the present invention tends to provide an improved adjustment assembly to mitigate the aforementioned problems.

SUMMARY OF THE INVENTION

The primary objective of the present invention is to provide an adjustment assembly having a pair of adjustment disks securely mounted on a frame of the universal exercising machine and respectively having positioning holes and passages defined to communicate the positioning holes and a pair of blocks each having thereon resilient rods and being movable relative to the adjustment disks such that when the two blocks are moved, the inclinations of the resilient rods are changed and the user is able to comfortably exercise wherever selected.

In one aspect of the present invention, an adjustment device is provided to and movably received in the positioning holes of the pair of adjustment disks to position the pair of blocks so that after the inclination adjustments of the blocks are completed, the adjustment device is able to secure the positions of the two blocks as well as the resilient rod inclinations.

Other objects, advantages and novel features of the invention will become more apparent from the following detailed description when taken in conjunction with the accompanying drawings.

DETAILED DESCRIPTION OF THE PREFERRED EMBODIMENT

Figure 1:
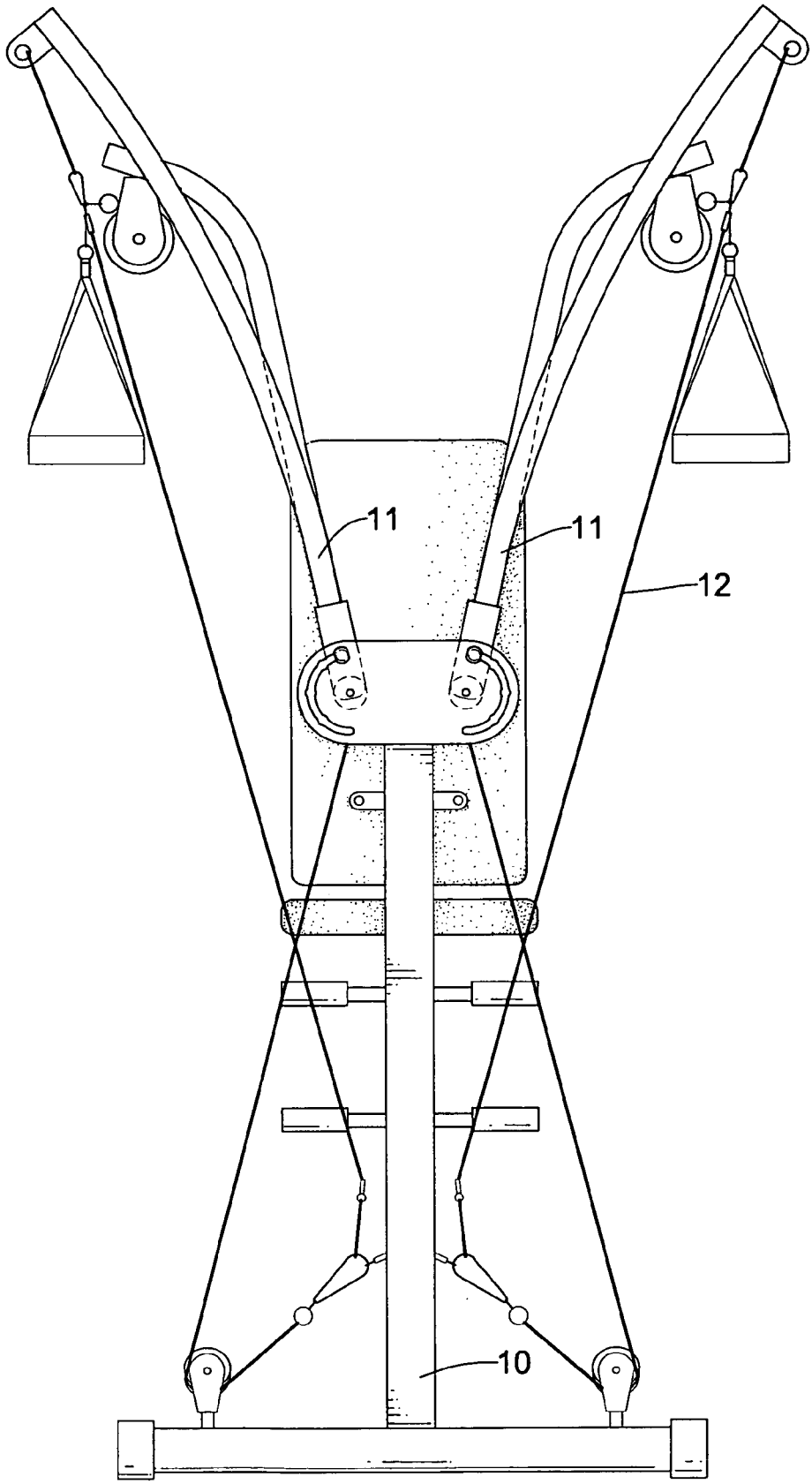
FIG. 1 is a rear plan view of a universal exercising machine with the adjustment assembly of the present invention.

With reference to FIG. 1, it is noted that the universal exercising machine includes a frame (10) where a user is able to stand, sit or lay down to exercise on different muscle groups, two groups of resilient rods (11) respectively connected to the frame (10) in two different directions and movable relative to the frame (10) and two handle cables (12) respectively extending from two corresponding resilient rods (11).

Figure 2:
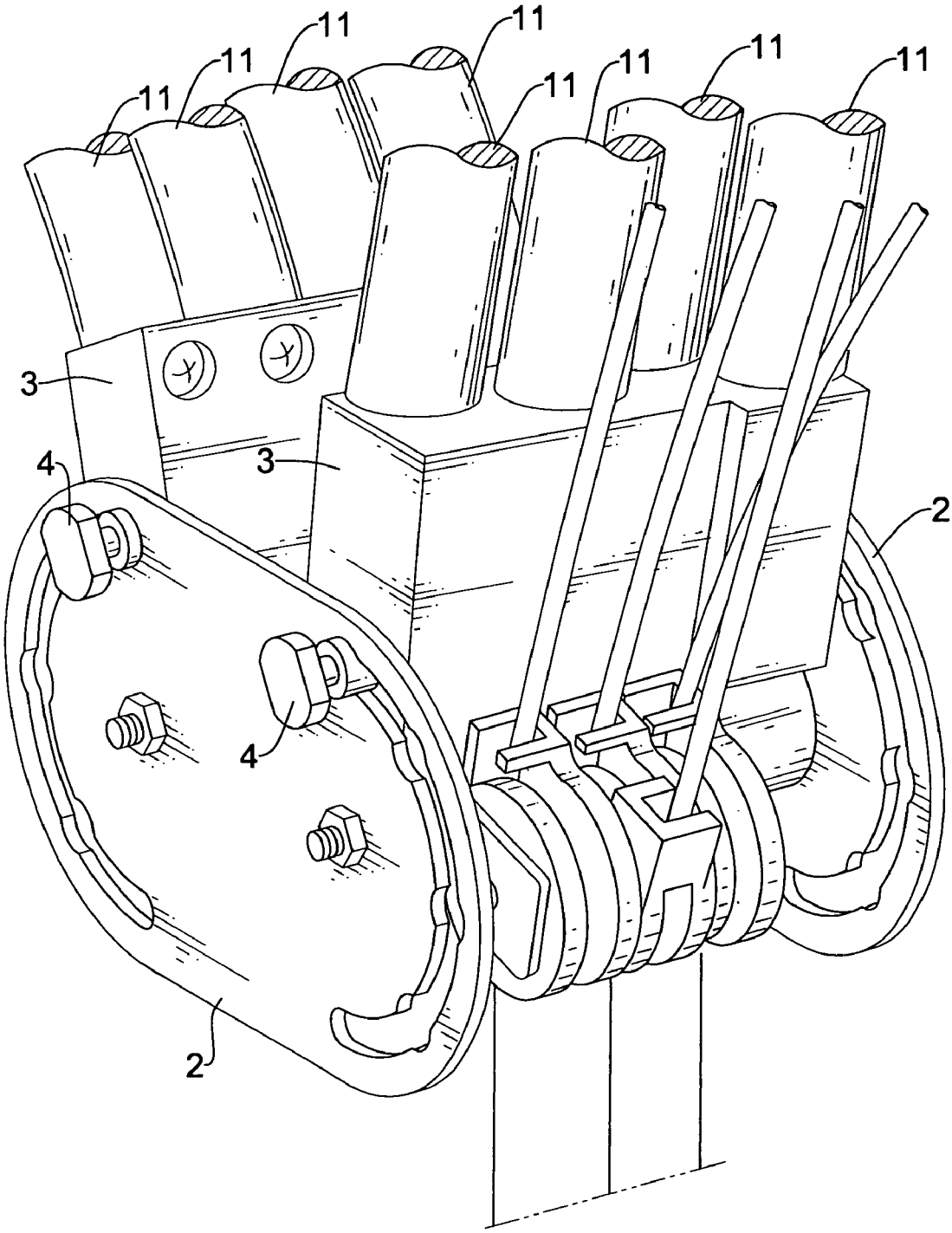
FIG. 2 is a perspective enlarged view of the adjustment assembly in accordance with the present invention.

With reference to FIG. 2, it is noted that the adjustment assembly in accordance with the present invention includes two adjustment disks (2), two blocks (3) and two adjustment devices (4). From the depiction of FIG. 2, each group of resilient rods (11) is firmly connected to a corresponding one of the two blocks (3) and the two adjustment disks (2) are respectively provided to securely sandwich the two blocks (3) via the two adjustment devices (4). Because the adjustment of one of the blocks (3) is the same as the other, the following discussion will be focused on the configuration and adjustment of only one side of the exercising machine.

Figure 3:
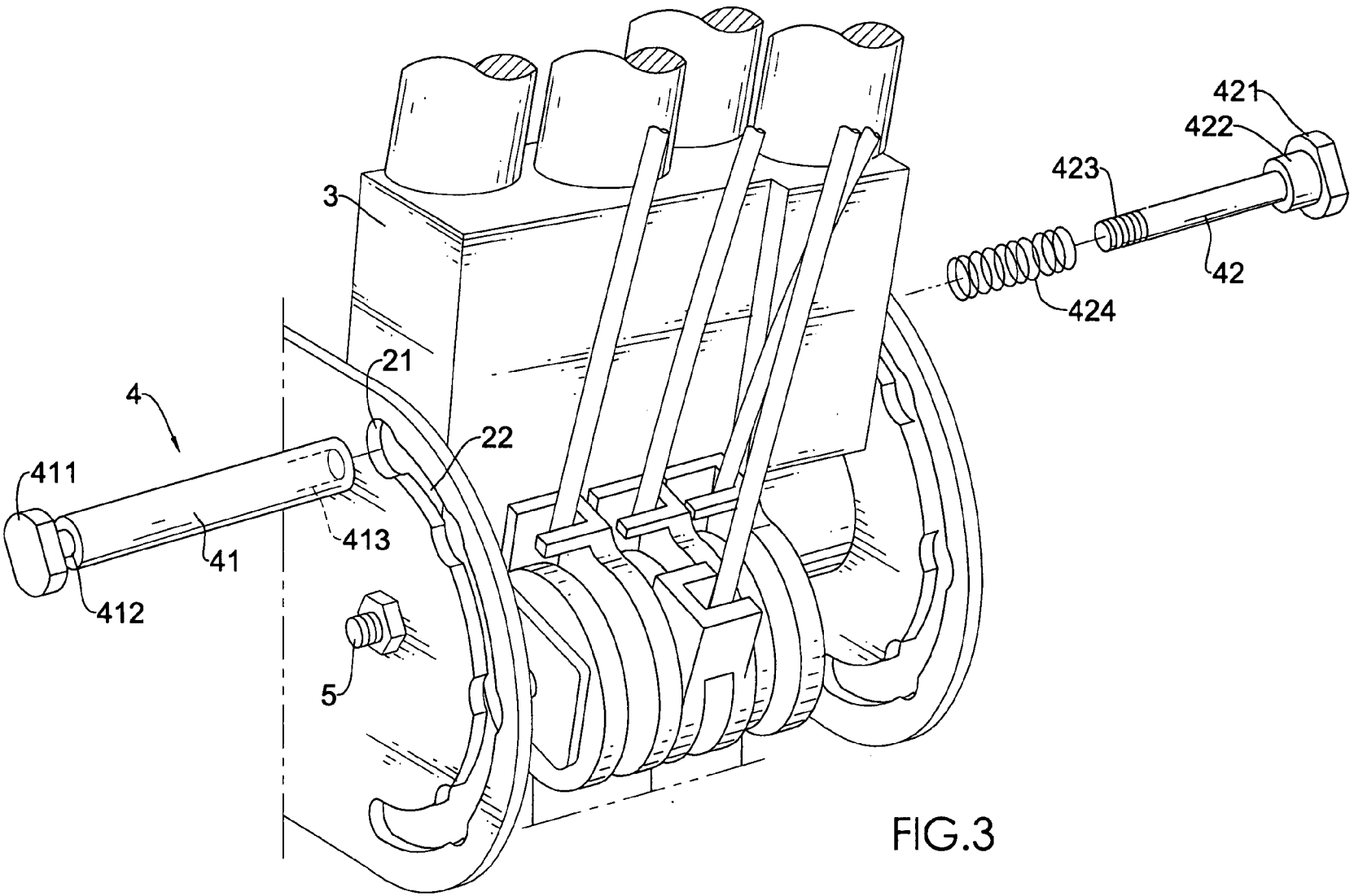
FIG. 3 is an exploded perspective view showing the adjustment device of the present invention.

Referring to FIG. 3, each adjustment disk (2) is provided with two sets of openings (21) respectively defined in opposed ends of the adjustment disk (2) and a passage (22) is defined to communicate with each set of the openings (21). It is noted that the passage (22) has a dimension smaller than that of the opening (21).

Each adjustment device (4) has a first shank (41) and a second shank (42). The first shank (41) is provided with a first head (411) formed on an end of the first shank (41) and having a dimension larger than that of the passage (22) but slightly smaller than that of the opening (21), a neck (412) extending from a side of the head (411) and having a dimension smaller than that of the passage (22) and a path (413) defined in an end of the first shank (41) opposite to the first head (411). The second shank (42) is provided with a second head (421) formed on an end of the second shank (42), a flange (422) formed on a side face of the second head (421) and having a dimension larger than that of the passage (22) but slightly smaller than that of the opening (21), a thread end (423) formed on an end of the second shank (42) opposite to the second head (421) and a recoil spring (424).

Figure 4B:
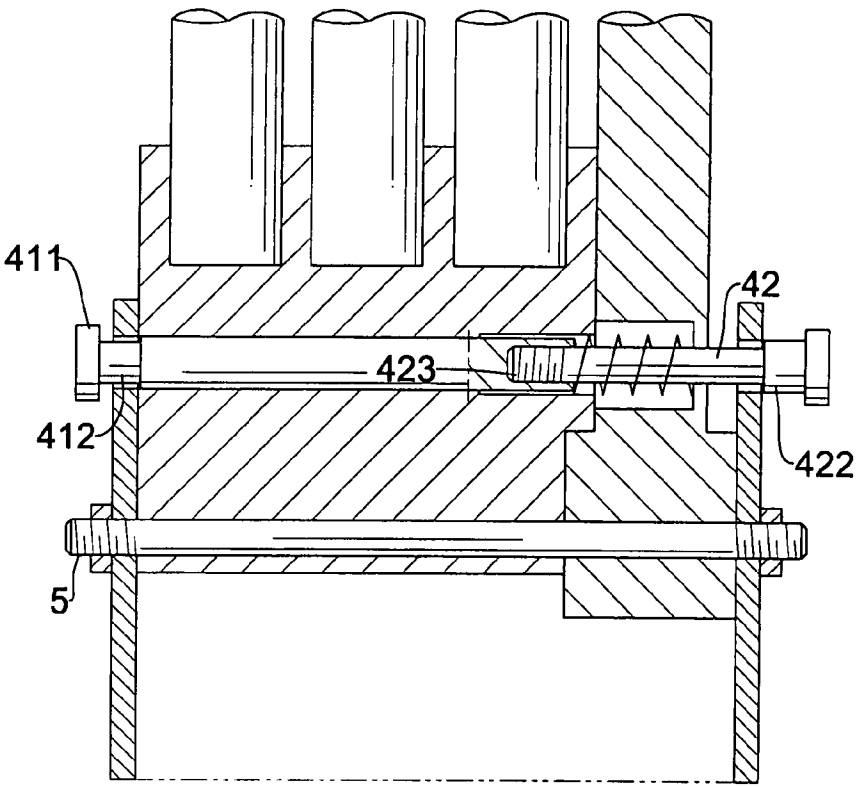
FIG. 4B is a schematic cross sectional view showing the adjustment device is applied to allow the block to move relative to the adjustment disks.
Figure 4A:
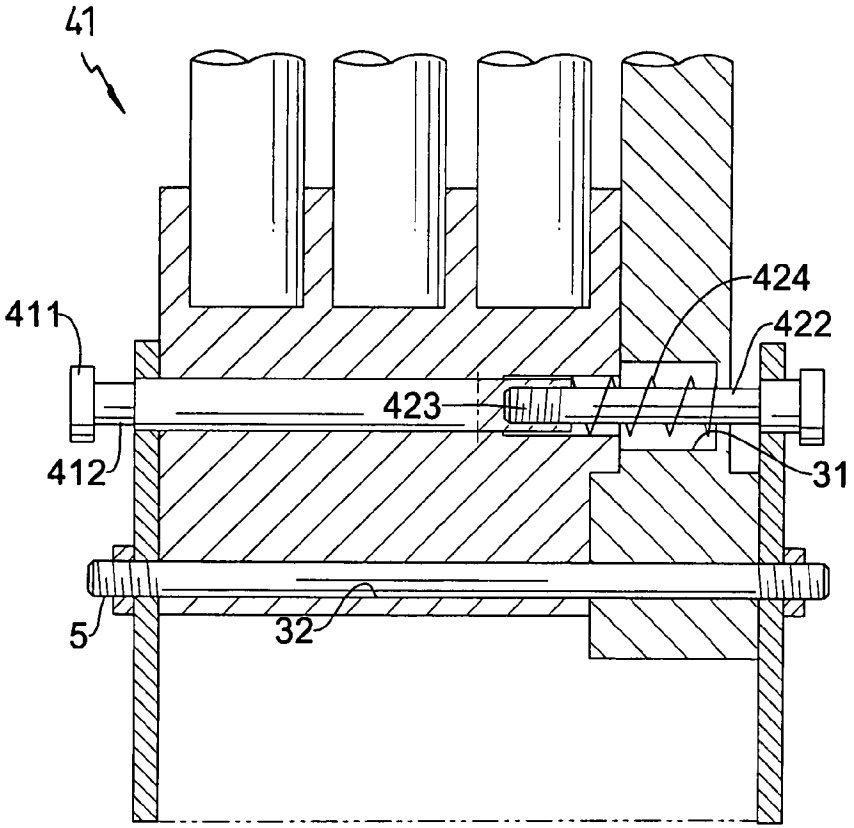
FIG. 4A is a schematic cross sectional view showing that the adjustment device is applied to secure the block.

With reference to FIGS. 4A and 4B, it is noted that each block (3) has a first pathway (31) and a second pathway (32) defined through the block (3) to respectively allow extension of the adjustment device (4) and a securing stud and nut combination (5) to combine the block (3) with two adjustment disks (2). When the block (3) is secured between the two adjustment disks (2) via the securing stud and nut combination (5), the recoil spring (424) is mounted around the second shank (42) and the threaded end (423) of the second shank (42) is threadingly extended into the path (413) while the recoil spring (424) is abutted by an inner periphery defining the opening (31) and an outer periphery defining the path (413). Furthermore, it is noted that the flange (422) is received in a corresponding one of the openings (31) and the first shank (41) is also received in a corresponding one of the openings (31). Because the dimension of the flange (422) as well as the first shank (41) is larger than that of the passage (22), the block (3) is immovable relative to the two adjustment disks (2).

Figure 5A:
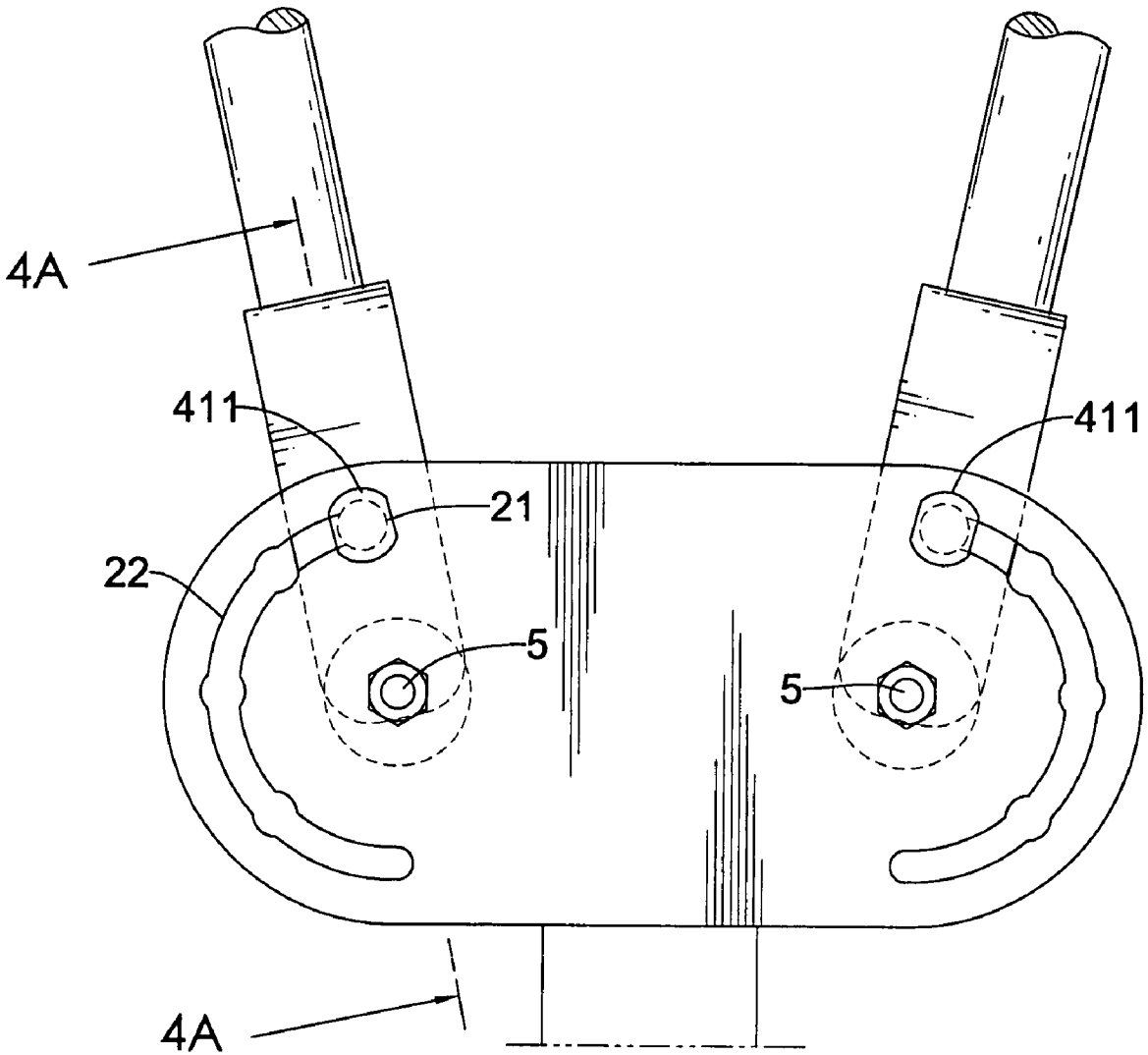
FIG. 5A is a schematic plan view showing a status of the two blocks as well as the resilient rods before the adjustment.
Figure 5B:
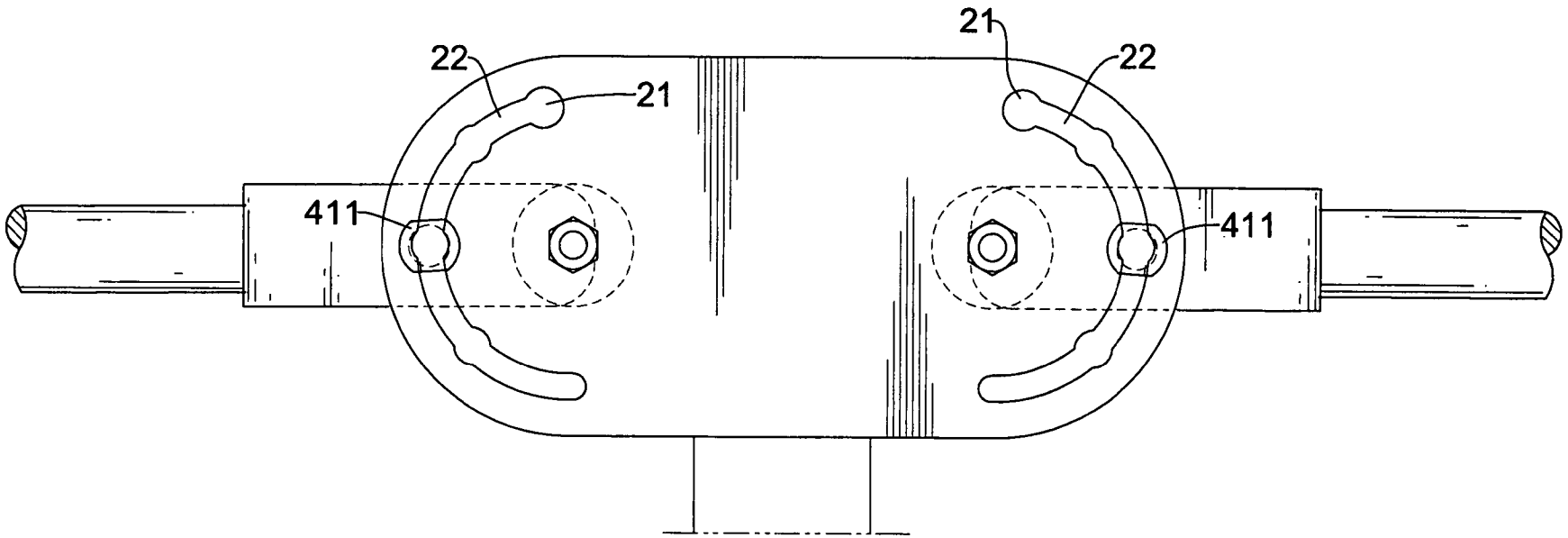
FIG. 5B is a schematic plan view showing a status of the two blocks as well as the resilient rods after the adjustment.
Figure 6:
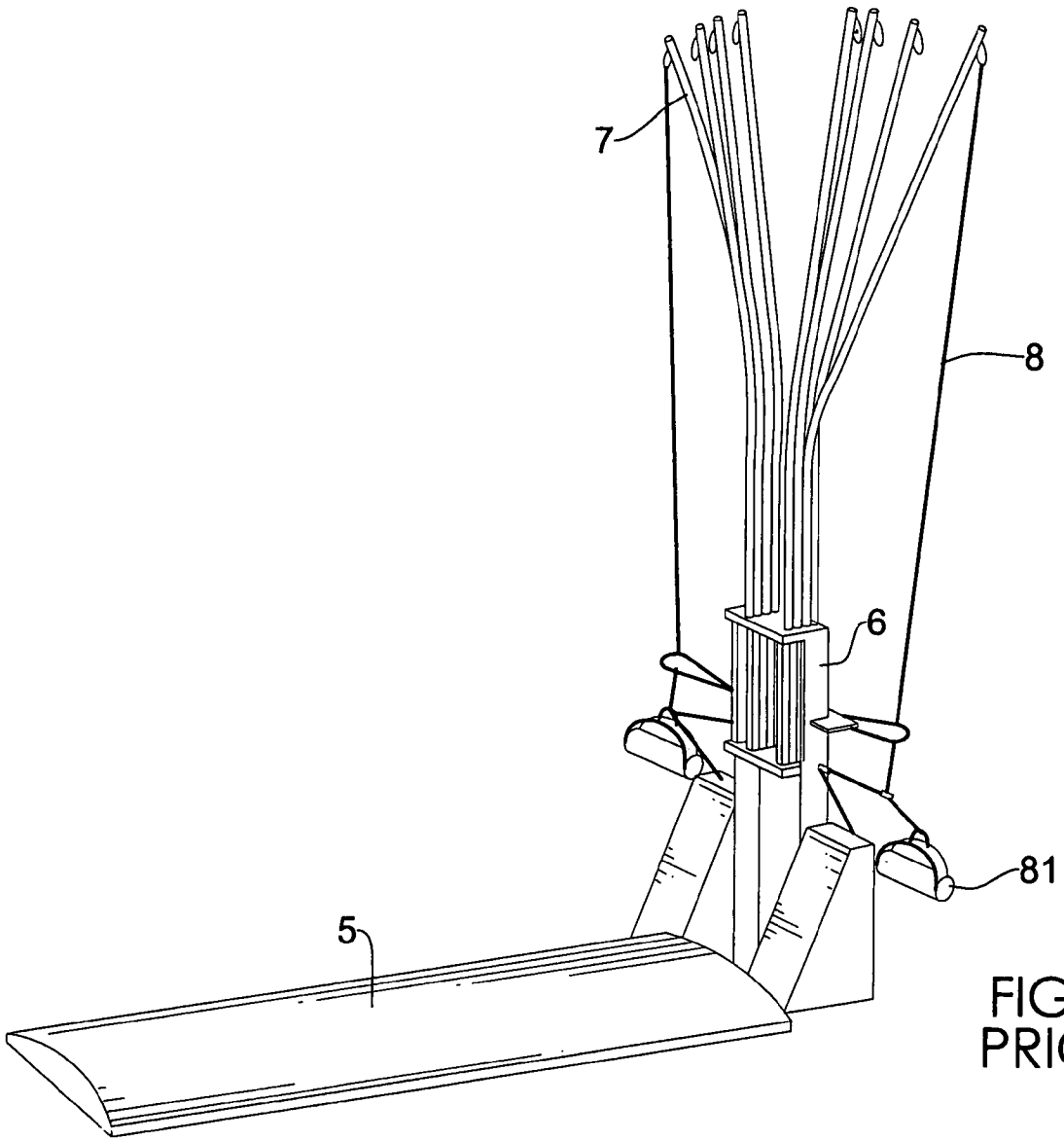
FIG.6 PRIOR ART
FIG. 6 is a perspective view of a conventional universal exercising machine.

With reference to FIGS. 5A and 5B and still using FIGS. 4A and 4B for reference, when the second shank (42) is pulled to simultaneously drive the first shank (41) to move in a direction the same as that of the second shank (42) so as to allow the neck (412) of the first shank (41) and a portion of the second shank (42) to be received in the opening (21), because the dimension of the neck (412) as well as the second shank (42) is smaller than that of the passage (22), the user is able to adjust the angle of the block (3) inside the two adjustment disks (2). After the adjustment, the user releases the second shank (42), due to the recoil force from the recoil spring (424), the first shank (41) and the second shank (42) are returned to their respective positions.

Therefore, it is noted that because the provision of the adjustment assembly of the present invention, the blocks (3) as well as the resilient rods (11) are movable relative to the frame (10) such that the user is able to easily adjust the angle of the two sets of resilient rods (11) to allow exercise on different body portions.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An adjustment assembly for a universal exercising machine having a frame, two groups of resilient rods respectively connected to the frame in two different directions and two handle cables respectively extending from two corresponding resilient rods, the adjustment assembly comprising:

two blocks respectively adapted to have the resilient rods to be mounted thereon and being movable relative to the frame and each block having a first pathway and a second pathway to respectively allow extension of an adjustment device and a securing stud and nut combination;

two adjustment disks to sandwich therebetween the two blocks, each adjustment disk having two sets of openings respectively defined in two opposed sides of the adjustment disk and two passages respectively provided to communicate with one set of openings, wherein each opening has a dimension larger than that of the passages, wherein the adjustment device has a first shank and a second shank securely connected to the first shank, the first shank has a dimension larger than that of the passage yet smaller than that of the openings, a first head formed on an end of the first shank and a neck formed between the first shank and the first head and having a dimension smaller than that of the passage so that when the first shank is received in a corresponding one of the openings, the first shank is immovable relative to the two adjustment disks and when the neck is received in the passage, the first shank is movable relative to the two adjustment disks, the second shank has a second head, a flange formed between the second head and the second shank and having a dimension larger than that of the passage yet smaller than the openings and a recoil spring mounted around the second shank and abutted between an inner periphery defining the opening and a face of the first shank, the second shank has a dimension smaller than that of the passage such that when the flange is received in a corresponding one of the openings, the second shank is immovable relative to the two adjustment disks and when the second shank is received in the passage, the second shank is movable relative to the two adjustment disks, so that when the adjustment device is selectively received in the passage, the blocks are able to be moved relative to the frame.

2. The adjustment assembly as claimed in claim 1, wherein the first shank further has a path defined in an end of the first shank opposite to the first head and the second shank has a threaded end formed on an end of the second shank opposite to the second head to correspond to the path so that the threaded end of the second shank is able to threadingly extend into the path to secure engagement between the first shank and the second shank.

* * * * *